US009290017B2

(12) United States Patent
Yoshida

(10) Patent No.: US 9,290,017 B2
(45) Date of Patent: Mar. 22, 2016

(54) LIQUID EJECTING APPARATUS

(71) Applicant: SEIKO EPSON CORPORATION, Tokyo (JP)

(72) Inventor: Atsushi Yoshida, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 66 days.

(21) Appl. No.: 14/531,600

(22) Filed: Nov. 3, 2014

(65) Prior Publication Data

US 2015/0124018 A1 May 7, 2015

(30) Foreign Application Priority Data

Nov. 1, 2013 (JP) ..... 2013-228679

(51) Int. Cl.
*B41J 11/00* (2006.01)
*B41J 2/165* (2006.01)

(52) U.S. Cl.
CPC ..... *B41J 11/002* (2013.01); *B41J 2/165* (2013.01); *B41J 2/16505* (2013.01); *B41J 2/16523* (2013.01)

(58) Field of Classification Search
CPC ..... B41J 11/002; B41J 11/0015; B41J 11/42; B41J 29/393; B41J 2/16523; B41J 2/16505; B41J 2/165
See application file for complete search history.

(56) References Cited

U.S. PATENT DOCUMENTS

| | | | | |
|---|---|---|---|---|
| 2011/0234681 | A1* | 9/2011 | Nakane | 347/20 |
| 2012/0249651 | A1* | 10/2012 | Akiyama et al. | 347/16 |
| 2012/0327147 | A1* | 12/2012 | Okawa et al. | 347/9 |
| 2013/0169708 | A1* | 7/2013 | Yoshida et al. | 347/6 |

FOREIGN PATENT DOCUMENTS

| | | |
|---|---|---|
| JP | 2004-174900 | 6/2004 |
| JP | 2004-314478 | 11/2004 |
| JP | 2005-125513 | 5/2005 |
| JP | 2011-110488 | 6/2011 |

* cited by examiner

*Primary Examiner* — Julian Huffman
(74) *Attorney, Agent, or Firm* — Workman Nydegger

(57) ABSTRACT

A liquid ejecting apparatus includes a liquid ejecting head that ejects a plurality of kinds of photocurable type liquids, an irradiation unit that irradiates light that cures the liquids, a liquid receiving portion that is capable of receiving the liquids that are ejected from the liquid ejecting head, and a control unit that controls the ejection of the liquids from the liquid ejecting head. Among the plurality of kinds of liquids that are ejected, the control unit ejects a liquid that is cured with most ease when the light is irradiated before at least one different liquid other than the liquid in a case in which the plurality of kinds of liquids are ejected into the liquid receiving portion from the liquid ejecting head.

6 Claims, 5 Drawing Sheets

LIQUID EJECTING APPARATUS

BACKGROUND

1. Technical Field

The present invention relates to a liquid ejecting apparatus that ejects a photocurable type liquid onto a medium.

2. Related Art

In the related art, an ink jet type printer that is provided with a liquid ejecting head that ejects UV curable type ink that is cured by being irradiated with ultraviolet rays (hereinafter, also referred to as "UV" rays), and an irradiation unit that cures ink by irradiating a medium on which the ink has been ejected from the liquid ejecting head with UV light, is known as an example of a liquid ejecting apparatus (for example, JP-A-2005-125513).

In addition, in this kind of printer, so-called flushing, which ejects ink from the liquid ejecting head as waste liquid on the basis of a control signal that is not related to printing, is performed as a kind of maintenance of the liquid ejecting head. As a liquid receiving portion that is used in flushing, for example, a liquid receiving portion that has a bottomed box-shape in which the upper part is open, is widely known, and there are also cases in which an absorber, which is capable of absorbing ink, is accommodated inside the liquid receiving portion. Additionally, as one example, among regions in which the liquid ejecting head reciprocates in a main scanning direction, the liquid receiving portion is disposed next to a printing region, in which ink is ejected from the liquid ejecting head onto a medium, which is transported in a sub-scanning direction that is perpendicular to the main scanning direction.

Further, a control device of the printer moves the liquid ejecting head to a position that opposes the liquid receiving portion, and performs flushing toward the liquid receiving portion from the liquid ejecting head when it is determined that a condition for executing flushing has been established. When flushing is executed, ink that is ejected from the liquid ejecting head as waste liquid and received in the liquid receiving portion either evaporates as time passes or is discharged to a waste ink tank from an ink discharge outlet that is formed in the bottom portion of the liquid receiving portion.

Given that, in a case in which ink is ejected onto a medium for printing after flushing has finished, the liquid ejecting head moves from a previous position that opposes the liquid receiving portion to a printing region, which is a position that opposes the medium. Further, when the liquid ejecting head ejects ink onto the medium in the printing region, the irradiation unit irradiates the medium with UV light in the printing region.

However, in such a case, a portion of the UV light, which is irradiated in the printing region toward the medium from the irradiation unit may be incident upon the liquid receiving portion that is disposed next to the printing region as leaked light from the printing region. Therefore, deposits may be formed in the liquid receiving portion or clogging may occur in the ink discharge outlet as a result of ink (in particular, ink that is cured with relative ease) that is received in the liquid receiving portion being cured by the abovementioned leaked light. Therefore, there is a concern that the maintenance function of the liquid receiving portion will be reduced. Additionally, the technical problem that is outlined above is not limited to printers that eject UV curable type ink, and is a general problem that is common to liquid ejecting apparatuses that eject photocurable type liquid.

SUMMARY

An advantage of some aspects of the invention is to provide a liquid ejecting apparatus that can suppress reductions in the maintenance function of the liquid receiving portion.

Hereinafter, means of the invention and the operational effects thereof will be described.

According to an aspect of the invention, a liquid ejecting apparatus includes a liquid ejecting head that ejects a plurality of kinds of photocurable type liquids, an irradiation unit that irradiates light that cures the liquids, a liquid receiving portion that is capable of receiving the liquids that are ejected from the liquid ejecting head, and a control unit that controls the ejection of the liquids from the liquid ejecting head, in which, among the plurality of kinds of liquids that are ejected, the control unit ejects a liquid that is cured with most ease when the light is irradiated before at least one different liquid other than the liquid in a case in which the plurality of kinds of liquids are ejected into the liquid receiving portion from the liquid ejecting head.

According to the abovementioned configuration, after flushing that ejects the plurality of kinds of liquids toward the liquid receiving portion from the liquid ejecting head as waste liquid has finished, in the liquid receiving portion, among the plurality of kinds of liquids for which flushing is performed, a liquid that is cured with most ease when the light is irradiated is covered with at least one different liquid that is cured with more difficulty than the liquid. Therefore, even in a case in which light that cures the liquids is incident upon the liquid receiving portion, such light is absorbed by at least one different liquid other than the liquid that is cured with most ease. That is, it is possible to suppress a concern that the liquid that is cured with most ease may be cured in the liquid receiving portion by such light, and for example, deposits may be formed. Therefore, it is possible to suppress reductions in the maintenance function of the liquid receiving portion that is capable of performing maintenance of the liquid ejecting head by receiving liquids that are ejected as waste liquid from the liquid ejecting head that ejects photocurable type liquid.

In addition, in the liquid ejecting apparatus, it is preferable that, among the plurality of kinds of liquids that are ejected, the control unit eject a liquid that is cured with most difficulty when the light is irradiated last in a case in which the plurality of kinds of liquids are ejected into the liquid receiving portion from the liquid ejecting head.

According to the abovementioned configuration, when light that cures the liquids is incident upon the liquid receiving portion after flushing has finished, among the plurality of kinds of liquids that are ejected into the liquid receiving portion as waste liquid, the light is absorbed by the liquid that is cured with most difficulty. Therefore, it is possible to further suppress a case in which photocurable type liquid that is received in the liquid receiving portion is cured.

In addition, in the liquid ejecting apparatus, it is preferable that, among the plurality of kinds of liquids that are ejected, the control unit eject the liquid that is cured with most ease when the light is irradiated before all different liquids in a case in which the plurality of kinds of liquids are ejected into the liquid receiving portion from the liquid ejecting head.

According to the abovementioned configuration, when light that cures the liquids is incident upon the liquid receiving portion after flushing has finished, it is possible to further suppress a concern that, among the plurality of kinds of liquids that are ejected into the liquid receiving portion as waste liquid, the light may be absorbed by the liquid that is cured with most ease.

In addition, in the liquid ejecting apparatus, it is preferable that, among the plurality of kinds of liquids that are ejected, the control unit makes an ejection amount of a liquid that is cured with difficulty when the light is irradiated, more than an ejection amount of a liquid that is cured with ease when the light is irradiated in a case in which the plurality of kinds of liquids are ejected into the liquid receiving portion from the liquid ejecting head.

According to the abovementioned configuration, after flushing has finished, the probability that, in the liquid receiving portion, a liquid that is cured with ease may be covered with a liquid that is cured with difficulty, is increased. Therefore, when light that cures the liquids is incident upon the liquid receiving portion after flushing has finished, it is possible to further suppress a case in which the liquid that is cured with ease is cured by the light.

In addition, in the liquid ejecting apparatus, it is preferable that the liquid ejecting head be capable of reciprocating between a position at which the liquids are ejected into the liquid receiving portion and a position at which the liquids are ejected onto a medium, a plurality of nozzle rows, which respectively correspond to the plurality of kinds of liquids that are supplied to the liquid ejecting head, be formed at predetermined intervals in a direction of the reciprocation, and an end portion nozzle row, which is located in the liquid ejecting head on an end portion side in a reciprocation direction, eject a liquid that is cured with most difficulty.

According to the abovementioned configuration, for example, when moving toward a position that opposes a medium from a position that opposes the liquid receiving portion, the liquid ejecting head can eject different ink other than the liquid that is cured with most difficulty into the liquid receiving portion before the liquid that is cured with most difficulty, and eject the liquid that is cured with most difficulty into the liquid receiving portion last. Therefore, it is possible to reduce the time of flushing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the liquid ejecting apparatus as an ink jet type printer 11 will be described with reference to the drawings.

Figure 1:
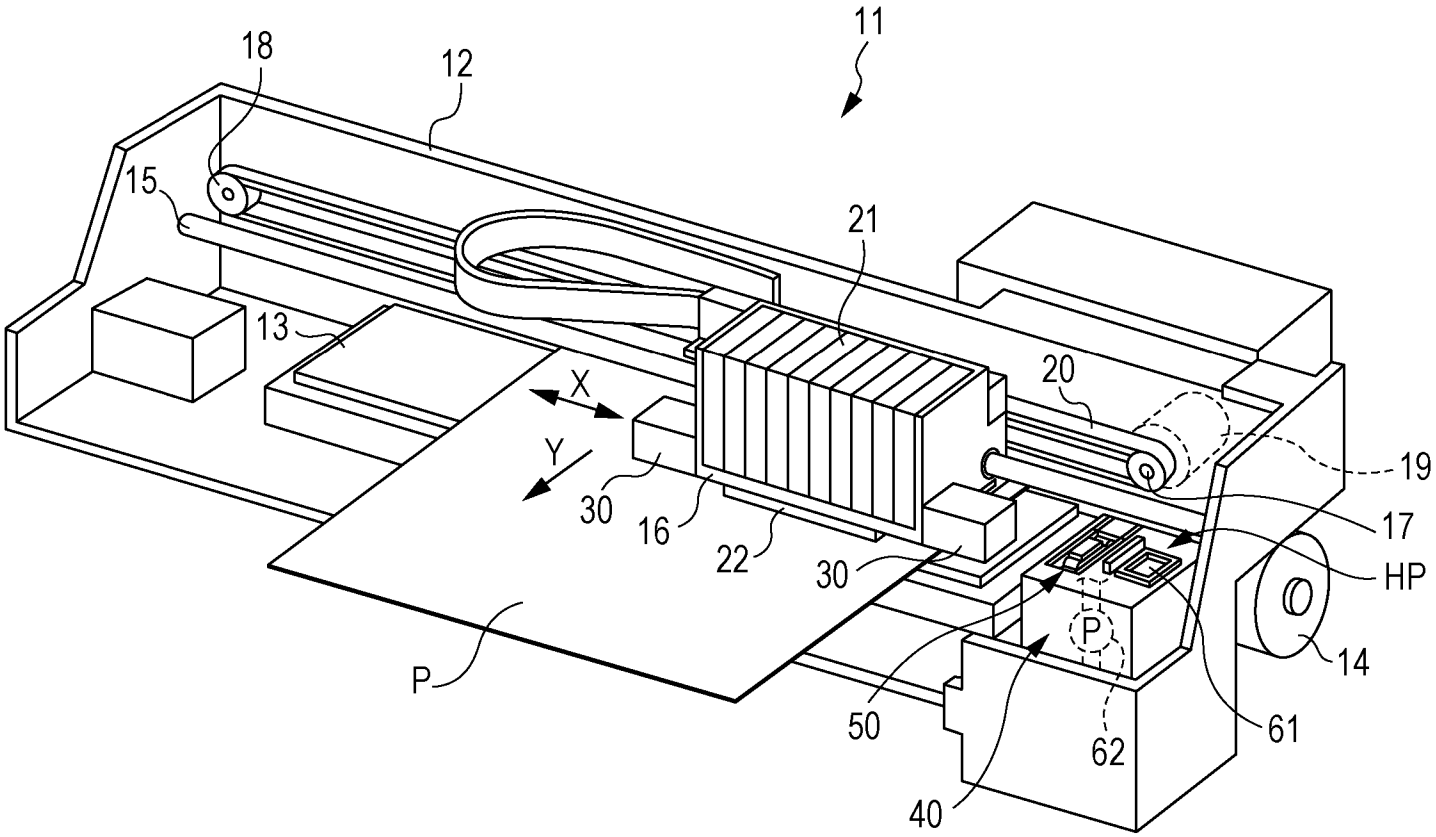
FIG. 1 is a schematic view that illustrates a printer of an embodiment.

As shown in FIG. 1, in the printer 11, a rectangular plate-shaped supporting member 13 that extends in a longitudinal direction of a frame 12 is disposed in a lower portion inside the frame 12 that has a substantially rectangular box shape. Further, sheets P, as an example of a medium, are transported onto the supporting member 13 by a paper feed roller 14 that is disposed in a lower portion of a back surface of the frame 12. Therefore, in the inside of the frame 12, a region in which the supporting member 13 is disposed is a printing region.

Inside the frame 12, a guide shaft 15 is provided in a hanging manner above the supporting member 13 along the longitudinal direction of the supporting member 13. A carriage 16 is supported on the guide shaft 15 in a slidable manner along the longitudinal direction thereof.

A drive pulley 17 and a driven pulley 18 are rotatably supported on the inner surface of a wall portion of a back surface side of the frame 12 at positions that correspond to both end portions of the guide shaft 15. An output shaft of a carriage motor 19 that is a drive source when reciprocating the carriage 16 is connected to the drive pulley 17, and an endless timing belt 20, a portion of which is connected to the carriage 16, is provided in a hanging manner between the pair of pulleys 17 and 18. Therefore, the carriage 16 moves along the longitudinal direction of the guide shaft 15 using the endless timing belt 20 due to drive power of the carriage motor 19 while being guided by the guide shaft 15.

A liquid ejecting head 22 is attached to a bottom surface side of the carriage 16. In addition, ink cartridges 21 for supplying UV curable type ink (hereinafter, referred to as "UV ink") as an example of a photocurable type ink to the liquid ejecting head 22 are installed in the carriage 16 in a detachable manner. The UV ink inside the ink cartridges 21 is set to be capable of being supplied from the ink cartridges 21 to the liquid ejecting head 22 with the consumption of UV ink inside the liquid ejecting head 22 due to ejection or the like by driving of piezoelectric elements that are provided in the liquid ejecting head 22. Further, printing is performed by supplied UV ink being ejected from the liquid ejecting head 22 onto sheets P that are transported onto the supporting member 13.

In addition, a pair of irradiation units 30 is attached to a side surface of the carriage 16. The pair of irradiation units 30 are attached to both sides of the liquid ejecting head 22 in a movement direction of the carriage 16 with the liquid ejecting head 22 interposed therebetween. Therefore, the pair of irradiation units 30 move in tandem with the movement of the carriage 16. Further, the pair of irradiation units 30 cure UV ink by irradiating UV ink that is ejected onto a sheet P with UV light. In this instance, UV light refers to light of a wavelength that is shorter than that of visible light (a wavelength of 380 nm to 780 nm) and longer than that of X-rays, and the upper limit of the wavelength range of ultraviolet rays is 380 nm to 400 nm, and the lower limit of the wavelength range of ultraviolet rays is 0.2 nm to 1 nm. Additionally, the ultraviolet rays that are irradiated from the pair of irradiation units 30 may be light of a single wavelength or may be light of a predetermined wavelength, but is light of a wavelength that photopolymerizes ink that is discharged from the liquid ejecting head 22.

In addition, one side of the inside of the frame 12 is a home position HP where the carriage 16 stands by when printing is not being performed. Inside the frame 12, a maintenance device 40 for performing maintenance such as cleaning of the liquid ejecting head 22, is disposed in the vicinity of the home position HP.

The maintenance device 40 has a flushing box 50 as a liquid receiving portion that is capable of receiving UV ink that is discharged as a result of so-called flushing when the liquid ejecting head 22 discharges UV ink as waste liquid on the basis of a control signal that is not related to printing. In addition, the maintenance device 40 is provided with a cap 61, which performs a suction processing operation that discharges UV ink from the nozzle group 23 (refer to FIG. 2)

using the suction of a suction pump 62 in a state of abutting against the liquid ejecting head 22 so as to surround a nozzle group 23.

Figure 2:
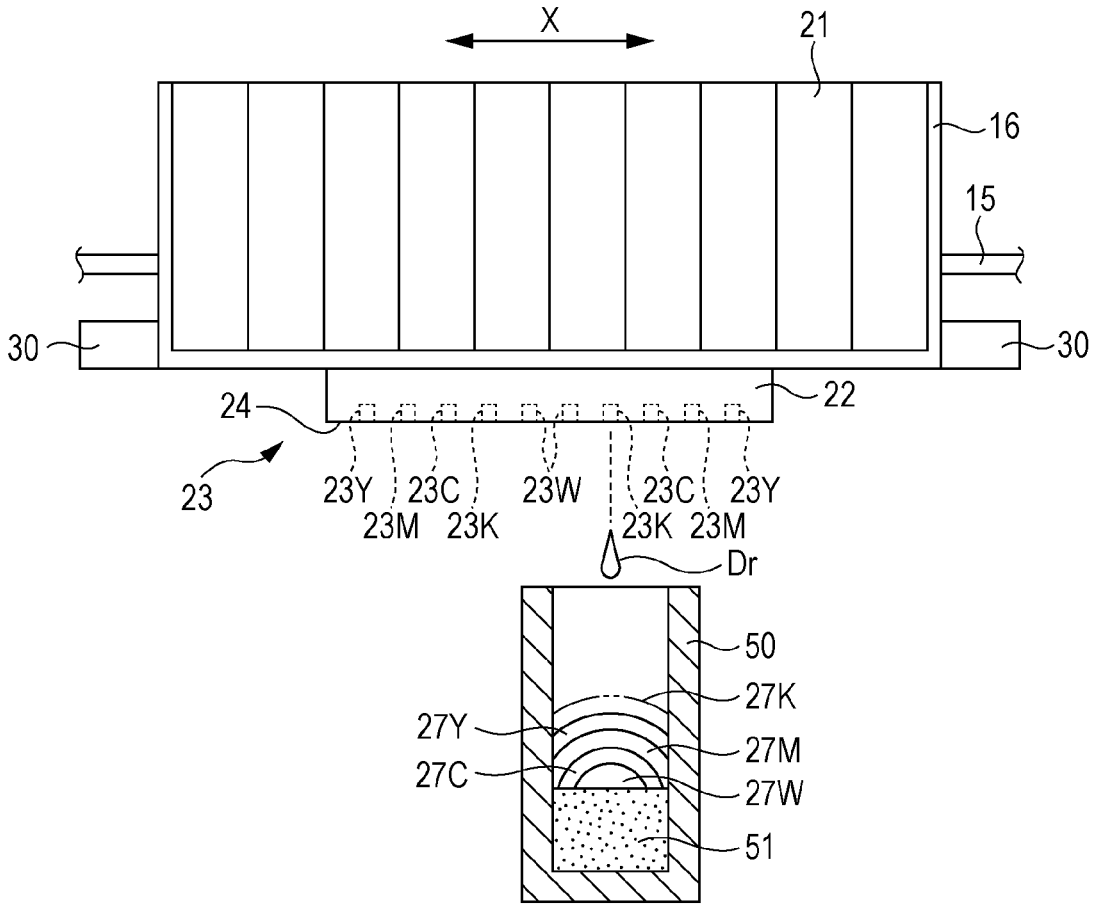
FIG. 2 is a front view that illustrating a carriage in the printer and a peripheral region of the carriage.

As shown in FIG. 2, the flushing box 50 that has a bottomed box-shape in which the upper part is open, accommodates an absorber 51 that is formed from a porous substance such as sponge that is capable of absorbing and retaining UV ink. The absorber 51 is disposed in the bottom portion of the flushing box 50.

Figure 3:
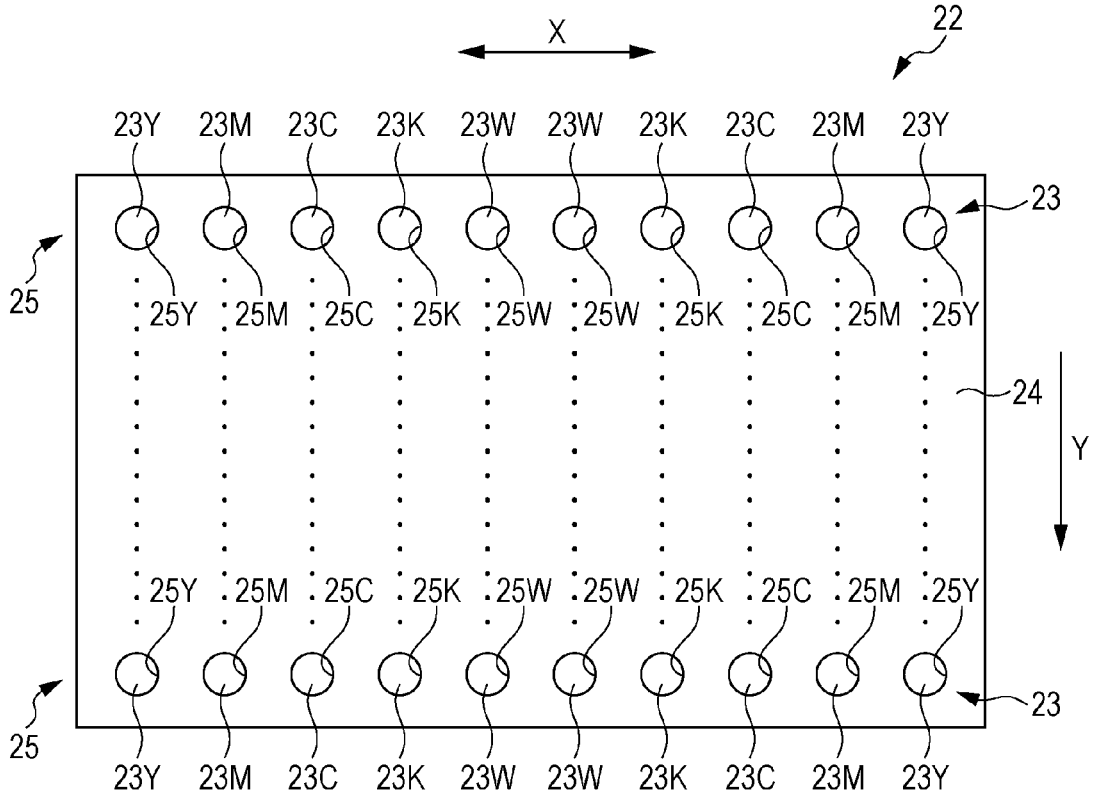
FIG. 3 is a bottom view of a liquid ejecting head in the printer.

The configuration of the liquid ejecting head 22 will be described in more detail with reference to FIGS. 2 and 3.

The nozzle group 23 that ejects different colors of UV ink is attached to the liquid ejecting head 22. The nozzle group 23 includes a nozzle for yellow 23Y that ejects yellow ink, a nozzle for magenta 23M that ejects magenta ink, and a nozzle for cyan 23C that ejects cyan ink. In addition, the nozzle group 23 includes a nozzle for black 23K that ejects black ink and a nozzle for white 23W that ejects white ink. Each of these nozzles of the nozzle group 23 is respectively connected to an ink cartridge 21 of the corresponding color.

In addition, each nozzle of the nozzle group 23 is disposed for example, in an order of the nozzle for yellow 23Y, the nozzle for magenta 23M, the nozzle for cyan 23C, the nozzle for black 23K and two nozzles for white 23W from the left side (a side that is opposite the home position HP) in FIGS. 1 and 2. Furthermore, the nozzles are disposed in an order of the nozzle for black 23K, the nozzle for cyan 23C, the nozzle for magenta 23M and the nozzle for yellow 23Y from next to the nozzles for white 23W. Additionally, each nozzle of the nozzle group 23 respectively forms a nozzle row that extends in a transport direction Y of the sheets P (a direction that is orthogonal to a paper surface in FIG. 2). The transport direction Y is perpendicular to a movement direction X in which the liquid ejecting head 22 reciprocates along with the carriage 16.

A plurality of nozzle openings 25 that form a downstream end of each nozzle 23Y, 23M, 23C, 23K and 23W of the nozzle group 23 is formed in a nozzle formation surface 24 that is formed on a lower surface side of the liquid ejecting head 22. The plurality of nozzle openings 25 include openings for yellow 25Y that correspond to the nozzles for yellow 23Y, openings for magenta 25M that correspond to the nozzles for magenta 23M and openings for cyan 25C that correspond to the nozzles for cyan 23C. In addition, the plurality of nozzle openings 25 include openings for black 25K that correspond to the nozzles for black 23K and openings for white 25W that correspond to the nozzles for white 23W.

The UV ink that the liquid ejecting head 22 ejects is, as an example, UV ink that is suitable for the "Curing Systems using Photoacids and Base Generators (Section 1)" and "Photoinduced Alternating Copolymers (Section 2)" of "Photocuring Systems (Chapter 4)" that are disclosed in "Photocuring Techniques—Selection and Blending Conditions of Resins and Initiators, and Measurement and Evaluation of Curing Degree (Technical Information Institute Co., Ltd.)". The UV ink is composed to include a color material, a polymerizable monomer (or a polymerizable oligomer), a photoinitiator and the like, and has a property of being cured as a result of receiving the irradiation of ultraviolet rays due to cross-linking and polymerization reactions of monomers that accompany the photoinitiator acting as a catalyst. However, it is also possible to exclude the photoinitiator in a case in which UV ink that is suitable for the abovementioned "Photoinduced Alternating Copolymers (Section 2)" is used as the UV ink that is used in the present embodiment.

The UV inks are roughly classified into radical polymerizable inks that include a radical polymerizable compound as a polymerizable compound, and cation polymerizable inks that include cation polymerizable compounds as a polymerizable compound. Either kind of UV ink can be applied to the present embodiment, and a hybrid type UV ink in which a radical polymerizable ink and a cation polymerizable ink are combined may also be used in the present embodiment.

The UV ink that is used in the present embodiment is prepared by adding auxiliary agents such as an antifoaming agent and a polymerization inhibitor to a mixture of a vehicle, a photopolymerization initiator and a pigment, and is in a state of being dissolved or dispersed in an organic solvent. The vehicle is prepared by controlling the viscosity of a photopolymerization curable oligomer or a monomer using a reactive diluent. Therefore, the solvent is not volatilized in order to cure the UV ink. As the vehicle, it is possible to use a monofunctional or a polyfunctional polymerizable compound. More specifically, examples include an oligomer (prepolymer) such as polyester acrylate, epoxy acrylate or urethane acrylate, and it is also possible to use these materials as a reactive diluent that adjusts the viscosity of ink.

As photopolymerization initiators, benzophenones, benzoins, acetophenones and thioxanthones are widely used.

It is possible to use any compound as the polymerization inhibitor provided the compound has a radical capturing capability and inhibits radical polymerization. However, in consideration of the discharge suitability in ink jet printers, at least one kind of compound selected from hydroquinones, catechols, hindered amines, phenols, phenothiazines and fused aromatic ring quinones are desirable.

In addition, the polymerization inhibitor may be carbon black, organic or inorganic particles in which a polymerization inhibiting functional group has been introduced to the surface thereof.

As the polymerization inhibiting functional group, for example, a hydroxyphenyl group, a dihydroxyphenyl group, a tetramethylpiperidinyl group, a fused aromatic ring and the like can be included.

The UV ink in the present embodiment is a liquid with a viscosity of 10 mPa·s to 500 mPa·s at 30° C., but in order to obtain an image of high quality, it is desirable that the UV ink be a UV ink with a viscosity of 40 mPa·s to 500 mPa·s. This is because smearing occurs on the recording medium and there is a deterioration in recording images if the UV ink is set as an ink with a low viscosity of 10 mPa·s or less, and there is a decrease in the smoothness of image quality if the UV ink is set as an ink with a high viscosity that exceeds 500 mPa·s. Additionally, a UV ink with which the image quality is most stable is UV ink with a viscosity of 40 mPa·s to 500 mPa·s.

In addition, in the present embodiment, the UV ink is preferably a liquid with a viscosity of 3 mPa·s to 30 mPa·s at 60° C., and more preferably a liquid with a viscosity of 3 mPa·s to 20 mPa·s. This is because there is a concern that it may be difficult to perform accurate landing in a case in which high-speed discharge is performed with a viscosity of 3 mPa·s or less, and there is a concern that there may be a deterioration in discharging properties with a viscosity that is greater than 30 mPa·s.

In addition, with respect to the UV ink that is used in the present embodiment, the ease of curing when UV rays of the same strength are irradiated, that is, the ink curing tendency differs depending on color. The UV ink of the present embodiment is easy to cure, that is, the ink curing tendency increases in the order of white, cyan, magenta, yellow and black.

Next, the electrical configuration of the printer 11 will be described.

Figure 4:
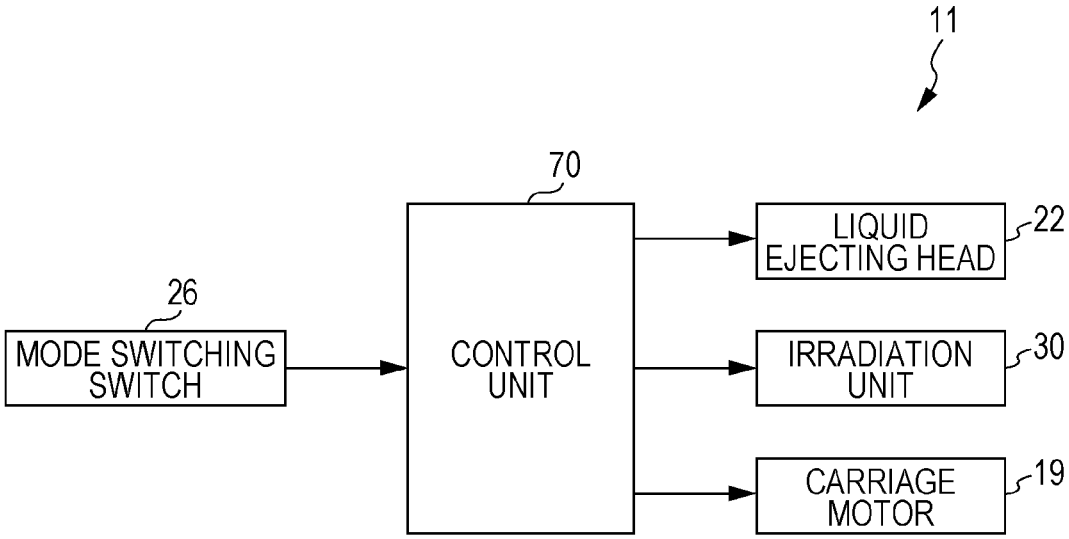
FIG. 4 is a block diagram that shows a control configuration of the printer.

As shown in FIG. 4, the printer 11 is provided with a control unit 70 that performs integrated control of the operations of the printer 11.

The control unit 70 controls the lighting and extinguishing timing, and irradiation strength of each LED (not shown in the drawings) that the pair of irradiation units 30 is provided with by transmitting control signals to the irradiation units 30. That is, the control unit 70 controls the irradiation operation of the UV ink on the sheets P (refer to FIG. 1) with UV light from the pair of irradiation units 30.

In addition, the control unit 70 switches an operation mode of the printer 11 on the basis of control signals that is input from a mode switching switch 26. The operation modes of the printer 11 include a printing mode that prints images on sheets P and a maintenance mode that includes flushing and the suction processing operation. Further, in addition to when the maintenance mode is selected, the control unit 70 also performs flushing in the liquid ejecting head 22 at a predetermined timing before printing, during printing or after printing when the printing mode is selected.

Furthermore, by transmitting control signals to the liquid ejecting head 22, the control unit 70 controls the driving of the of the piezo elements (not shown in the drawings) that are built into the liquid ejecting head 22. As an example of a control of the control unit 70 over the liquid ejecting head 22, a control that performs flushing is called a flushing control.

In addition, the control unit 70 controls the driving of the carriage motor 19. That is, the control unit 70 controls the movement operation of the carriage 16.

Figure 5:
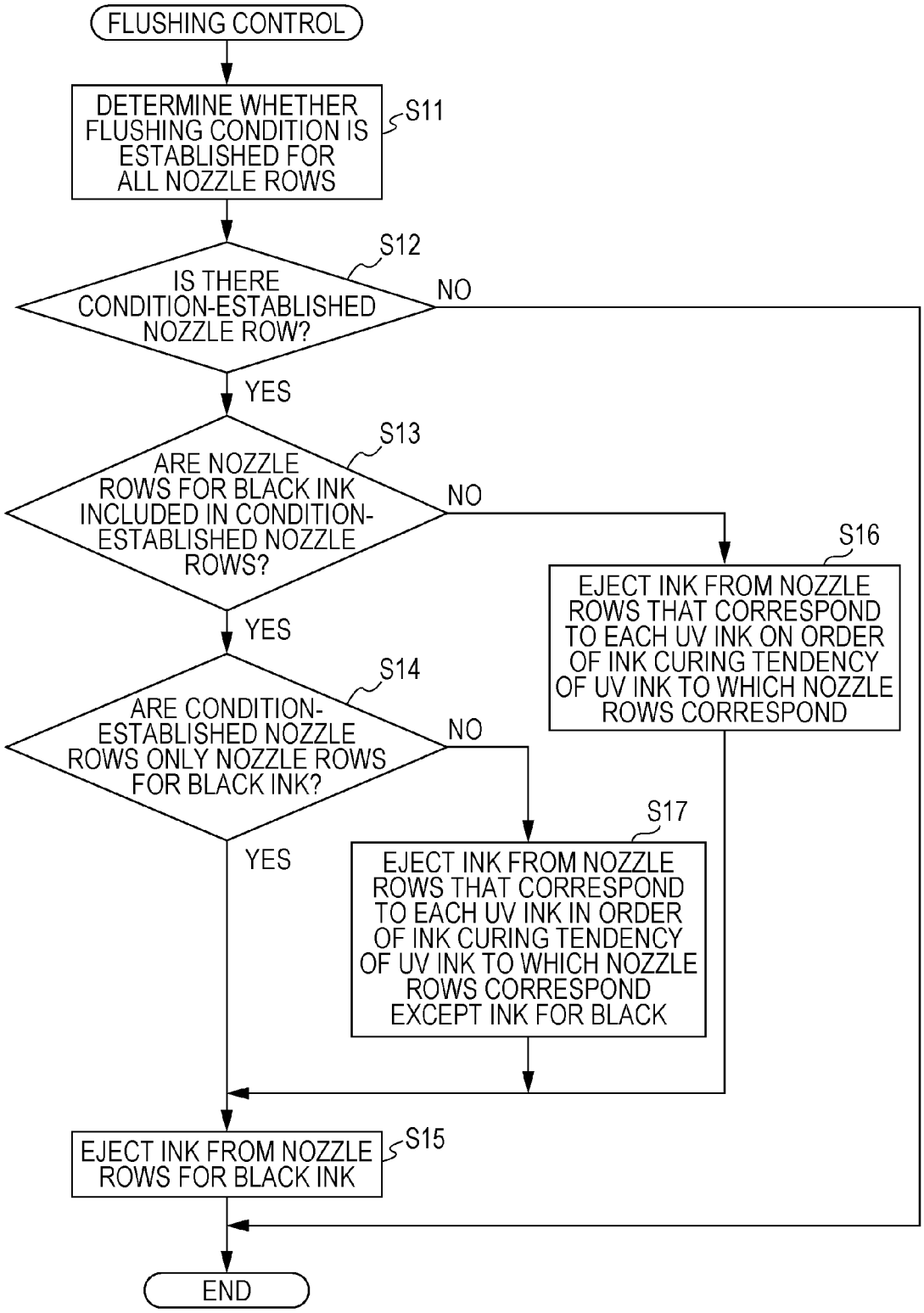
FIG. 5 is a flowchart that shows an example of a process sequence of a flushing process.

An example of the flushing control will be described with reference to FIG. 5.

The control unit 70 determines whether a flushing condition is established for all of the nozzle groups 23, or in more detail, whether a flushing condition is established for each nozzle row that is formed from nozzles of the same color (Step S11). As an example of a flushing condition, the number of times that a nozzle of each nozzle row has ejected UV ink in a reference time being less than a threshold is used.

The control unit 70 determines the presence or absence of nozzle rows (condition-established nozzle rows) for which the flushing condition has been established (Step S12). The control unit 70 finishes the current control in a case in which there are no condition-established nozzle rows (Step S12: NO). On the other hand, when the control unit 70 determines that there are condition-established nozzle rows (Step S12: YES), the control unit 70 determines whether or not nozzle rows of the nozzles for black 23K are included in the condition-established nozzle rows (Step S13).

When the control unit 70 determines that nozzle rows of the nozzles for black 23K are included in the condition-established nozzle rows (Step S13: YES), the control unit 70 determines whether or not the condition-established nozzle rows are only nozzle rows of the nozzles for black 23K (Step S14).

When the control unit 70 determines that the condition-established nozzle rows are only nozzle rows of the nozzles for black 23K (Step S14: YES), the control unit 70 ejects ink from the nozzle rows of the nozzles for black 23K and finishes the current control.

On the other hand, when the control unit 70 determines that the nozzle rows of the nozzles for black 23K are not included in the condition-established nozzle rows (Step S13: NO), the control unit 70 ejects ink from the nozzle rows that correspond to each UV ink in order of the ink curing tendency of UV ink to which the nozzle rows correspond (Step S16). Thereafter, the control unit 70 ejects ink from the nozzle rows of the nozzles for black 23K (Step S15) and finishes the current control.

When the control unit 70 determines that nozzle rows other than nozzle rows of the nozzles for black 23K are included in the condition-established nozzle rows (Step S14: YES), the control unit 70 ejects ink from the nozzle rows that correspond to each UV ink in order of the ink curing tendency of UV ink to which the nozzle rows correspond except nozzle rows of the nozzles for black 23K (Step S17). Thereafter, the control unit 70 ejects ink from the nozzle rows of the nozzles for black 23K (Step S15) and finishes the current control.

Next, the actions in the printer 11 that is configured in the abovementioned manner will be described below focusing on a case of flushing UV ink from the liquid ejecting head 22 into the flushing box 50 in particular.

Meanwhile, the liquid ejecting head 22 is capable of reciprocating along the movement direction X between the printing region and the home position HP with the carriage 16, and during flushing, moves to a position above the flushing box 50 in the home position HP. Further, as shown in FIG. 2, UV ink is ejected toward the flushing box 50 from nozzles of nozzle rows for which the flushing condition has been established. At this time, in a case in which plurality of kinds of UV ink are ejected, the UV ink that is cured by the irradiation of UV light with most ease is set first, and UV inks that are cured with more difficulty than the abovementioned UV ink are ejected toward the flushing box 50 in order of the ink curing tendency.

That is, FIG. 2 shows a state immediately following flushing of cyan ink and magenta ink in order of the difficulty with which they are cured after flushing of white ink, which is the UV ink that is cured with most ease, has been performed first. In this manner, by sequentially flushing the plurality of kinds of UV ink from the state of FIG. 2, white ink, which is the UV ink that is cured with most ease, is absorbed most quickly in the absorber 51 inside the flushing box 50 while diffusing from the top of the absorber 51 toward the lower portion of the absorber 51. Next, cyan ink and magenta ink are sequentially absorbed with a delay in the absorber 51 while diffusing from the top of the absorber 51 toward the lower portion of the absorber 51. Therefore, from the top, an ink layer 27M in which magenta ink is retained most, an ink layer 27C in which cyan ink is retained most, and an ink layer 27W in which white ink is retained most are formed on top of the absorber 51 and inside the absorber 51.

Further, as shown in FIG. 2, ink droplets Dr of yellow ink, which is the UV ink that is cured with more difficulty than each of the UV inks for which flushing has been performed so far, are ejected into the flushing box 50. Subsequently, yellow ink is absorbed in the absorber 51 while diffusing from the top of the absorber 51 toward the lower portion of the absorber 51 with a greater delay than white ink, cyan ink and magenta ink. Therefore, an ink layer 27Y in which yellow ink is retained most is formed on the topmost layer on top of the absorber 51 and inside the absorber 51.

Further, ink droplets Dr of black ink, which is the UV ink that is cured with most difficulty, are subsequently ejected into the flushing box 50. After that, as shown by the dotted line in FIG. 2, black ink that is ejected last is absorbed in the absorber 51 while diffusing from the top of the absorber 51 toward the lower portion of the absorber 51 with a delay that is greater than each UV ink that has already been ejected. Therefore, an ink layer 27K in which black ink is retained most is formed on the topmost layer on top of the absorber 51 and inside the absorber 51.

As a result of this, the ink layer 27W in which white ink, which is cured with most ease, is retained most does not form the topmost layer inside the flushing box 50, and the ink layer 27W is on the bottommost layer. Further, the ink layer 27K of black ink, which is cured with most difficulty, is on the topmost layer.

Therefore, even if UV light, which is irradiated toward a sheet P from the irradiation units 30 while ejecting UV ink onto the sheet P in the printing region, becomes leaked light and is incident upon the flushing box 50, such UV light is absorbed by the topmost ink layer 27K that black ink, the UV ink that is cured with most difficulty, forms. In other words, a concern that the UV light of such leaked light may be absorbed by the ink layer 27W, in which white ink, which is cured with most ease, is retained most, is suppressed by each ink layer 27C, 27M, 27Y and 27K that the different UV inks which are cured with more difficulty than white ink form in layers.

According to the abovementioned embodiment, it is possible to obtain the following effects.

(1) After flushing has finished, in the flushing box 50, white ink is covered with at least one different UV ink that is cured with more difficulty than white ink. Therefore, even in a case in which UV light is incident upon the flushing box 50, such UV light is absorbed by at least one different UV ink other than the white ink that is cured with most ease. That is, it is possible to suppress a concern that white ink that is cured with most ease may be cured in the flushing box 50 by such UV light, and for example, deposits may be formed. Therefore, it is possible to suppress reductions in the maintenance function of the flushing box 50 that is capable of performing maintenance of the liquid ejecting head 22 by receiving UV ink that are ejected as waste liquid from the liquid ejecting head 22.

(2) When UV light is incident upon the flushing box 50 after flushing has finished, among the plurality of kinds of UV ink that are ejected into the flushing box 50 as waste liquid, it is more likely that the UV light will be absorbed by black ink that is cured with most difficulty. Therefore, it is possible to further suppress a case in which the UV ink that is received in the flushing box 50 is cured.

(3) When nozzle rows of the nozzles for white 23W are included in the condition-established nozzle rows, flushing of white ink is performed first. Therefore, when UV light is incident upon the flushing box 50 after flushing has finished, it is possible to further suppress a concern that, among the plurality of kinds of UV ink that are ejected into the flushing box 50 as waste liquid, the UV light may be absorbed by white ink that is cured with most ease.

Additionally, in the abovementioned embodiment, the following changes may be made. In addition, it is possible to combine the following modification examples within a technically consistent range.

In Step S15 of the flushing control, it is possible to make an ejection amount of black ink more than the ejection amounts of different UV ink. As a result of this, after flushing has finished, the probability that, in the flushing box 50, UV ink that is cured with ease may be covered with a UV ink liquid that is cured with difficulty, is increased. Therefore, when UV light is incident upon the flushing box 50 after flushing has finished, it is possible to further suppress a case in which UV ink that is cured with ease is cured by the UV light.

It is possible to dispose the nozzle rows of the nozzles for black 23K at an end portion of the nozzle formation surface 24. By adopting the end portion nozzle rows as the nozzle rows of the nozzles for black 23K, for example, when moving toward a position that opposes a sheet P from a position that opposes the flushing box 50, the liquid ejecting head 22 can eject different UV ink other than black ink that is cured with most difficulty into the flushing box 50 before black ink. Therefore, in flushing, it is possible to eject black ink that is cured with most difficulty into the flushing box 50 last. Therefore, it is possible to reduce the time of flushing.

A nozzle row that ejects a transparent clear ink may be provided in place of at least one of each nozzle row of the nozzle group 23 or in addition to the nozzle rows of the nozzle group 23. The ink curing tendency of the clear ink is higher than that of white ink. Therefore, in a case in which a nozzle row that ejects clear ink is included in the condition-established nozzle rows, it is preferable to eject clear ink first in the flushing control.

In the flushing control, the control unit 70 may perform flushing of all nozzle rows without performing determination of whether a flushing condition is established. In this modification example, UV ink may be ejected in order of the ink curing tendency or black ink may be ejected last after ejecting UV ink other than black in an arbitrary order. In addition, in a case in which the flushing box 50 is set to be capable of ejecting a plurality of ink at the same time, black ink may be ejected last so as to cover the upper portion of a plurality of inks after ejecting the plurality of inks other than black at the same time.

The control unit 70 may finish flushing control in Step S16 when it is determined that nozzle rows of nozzles for black 23K are not included in the condition-established nozzle row in Step S13 of the flushing control. That is, black ink need not necessarily be ejected last. In addition, this modification example is not limited as long as white ink is not ejected last. That is, white ink need not necessarily be ejected first.

Flushing may be performed into the cap 61. In this modification example, by performing flushing control as described in the abovementioned embodiment that takes ink curing tendency into account, it is possible to suppress UV ink from curing on the surface of the cap 61.

In the abovementioned embodiment, provided the liquid is a photocurable type liquid, the printer 11 may be a printer that ejects or discharges a liquid other than ink. Additionally, the states of liquid that is discharged from the printer 11 as liquid droplets of minute amounts include a granular state, a tear-like state, or a thread-like state that leave a tail. In addition, the liquid in this instance may be a material which can be ejected from the printer 11. For example, as long as it is in the liquid phase, the liquid can include a liquid body having a high or low viscosity, a sol solution, a gel water, or other fluid bodies such as inorganic solvents, organic solvents, solutions, liquid resins, and liquid metals (metallic melts). Furthermore, in addition to a liquid as one-state of material, the liquid may include a material in which particles of a functional material made of a solid material such as pigments or metal particles are dissolved in a solvent, dispersed, or mixed. An ink such as that described in the abovementioned embodiment can be used as a representative example of the liquid.

The entire disclosure of Japanese Patent Application No. 2013-228679, filed Nov. 1, 2013 is expressly incorporated by reference herein.

What is claimed is:

1. A liquid ejecting apparatus comprising:

a liquid ejecting head that ejects a plurality of kinds of photocurable type liquids;

an irradiation unit that irradiates light that cures the liquids;

a liquid receiving portion that is capable of receiving the liquids that are ejected for performing maintenance of the liquid ejecting head; and a control unit that controls the ejection of the liquids from the liquid ejecting head, wherein, among the plurality of kinds of liquids that are ejected into the liquid receiving portion, the control unit controls the ejection such that a liquid that is most easily cured with irradiated light is ejected before at least one of the other liquids in a case in which the plurality of kinds of liquids are ejected into the liquid receiving portion from the liquid ejecting head.

2. The liquid ejecting apparatus according to claim 1, wherein, among the plurality of kinds of liquids that are ejected, the control unit controls the ejection such that a liquid that is hardest to cure with the irradiated light is ejected last in a case in which the plurality of kinds of liquids are ejected into the liquid receiving portion from the liquid ejecting head.

3. The liquid ejecting apparatus according to claim 1, wherein, among the plurality of kinds of liquids that are ejected, the control unit controls the ejection such that the liquid that is most easily cured with the irradiated light is ejected before all different liquids in a case in which the plurality of kinds of liquids are ejected into the liquid receiving portion from the liquid ejecting head.

4. The liquid ejecting apparatus according to claim 1, wherein, among the plurality of kinds of liquids that are ejected, the control unit controls the ejection such that an ejection amount of a liquid that is hardest to cure with the irradiated light is more than an ejection amount of a liquid that is easier to cure with the irradiated light in a case in which the plurality of kinds of liquids are ejected into the liquid receiving portion from the liquid ejecting head.

5. The liquid ejecting apparatus according to claim 1, wherein the liquid ejecting head is capable of reciprocating between a position at which the liquids are ejected into the liquid receiving portion and a position at which the liquids are ejected onto a medium, wherein a plurality of nozzle rows, which respectively correspond to the plurality of kinds of liquids that are supplied to the liquid ejecting head, are formed at predetermined intervals in a direction of the reciprocation, and wherein an end portion nozzle row, which is located in the liquid ejecting head on a side of an end portion in a reciprocation direction, ejects a liquid that is hardest to cure with the irradiated light.

6. The liquid ejecting apparatus according to claim 1, wherein one or more of the plurality of kinds of photocurable type liquids are ejected into the liquid receiving portion during a maintenance operation, wherein, when more than one photocurable type liquids are ejected, the photocurable type liquids are ejected sequentially based on their tendency to cure.

* * * * *